United States Patent [19]

Grilliot et al.

[11] Patent Number: 5,038,410

[45] Date of Patent: Aug. 13, 1991

[54] FIREFIGHTER'S GARMENT HAVING LINER DETECTION

[76] Inventors: William L. Grilliot; Mary I. Grilliot, both of 1986 Home Ave., Dayton, Ohio 45417

[21] Appl. No.: 358,206

[22] Filed: May 26, 1989

[51] Int. Cl.[5] ..... A41D 13/00

[52] U.S. Cl. ..... 2/81; 2/93; 2/97; 2/272

[58] Field of Search ..... 2/69, 79, 81, 85, 86, 2/93, 97, 272

[56] References Cited

U.S. PATENT DOCUMENTS

| | | | |
|---|---|---|---|
| 4,386,438 | 7/1983 | Evin | 2/272 |
| 4,507,806 | 2/1985 | Coombs | 2/97 |
| 4,667,344 | 5/1987 | Cooper | 2/93 |
| 4,768,233 | 9/1988 | Grilliot et al. | 2/81 |
| 4,774,725 | 10/1988 | Page | 2/81 |
| 4,817,210 | 4/1989 | Aldridge et al. | 2/81 |

*Primary Examiner*—Werner H. Schroeder
*Assistant Examiner*—Diana L. Biefeld
*Attorney, Agent, or Firm*—Jacox & Meckstroth

[57] ABSTRACT

A firefighter's garment which includes an outer shell and an inner liner. The inner liner has an extension member which extends therefrom and which extends from the outer shell. The extension member may hang downwardly from the outer shell to indicate that the inner liner is present within the outer shell. The extension member is attachable to the outer shell to indicate that the inner liner is present within the outer shell. A firefighter's garment of this invention may be a firefighter's coat or a firefighter's trousers.

5 Claims, 2 Drawing Sheets

FIG-1
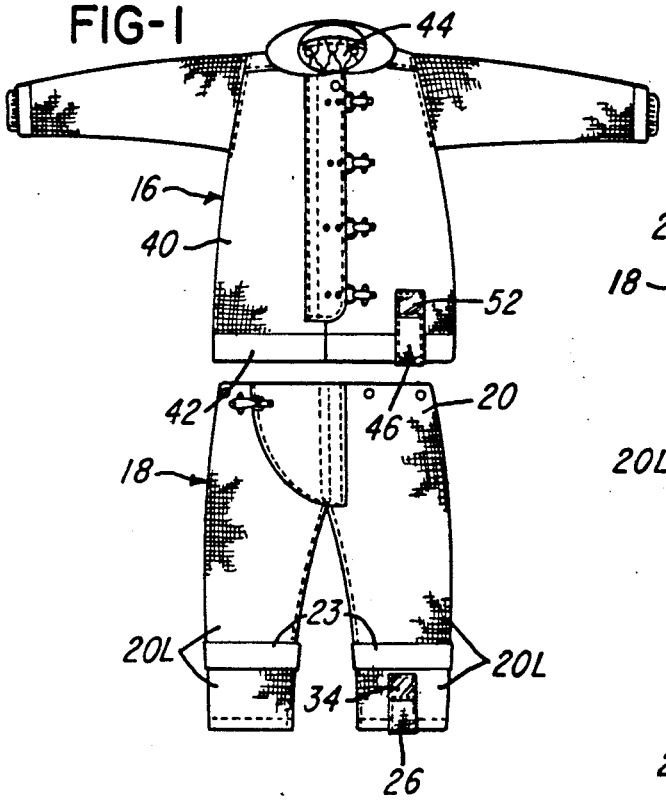
FIG-4
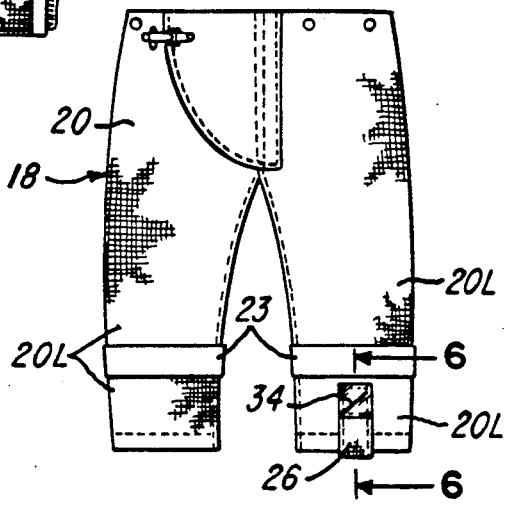
FIG-2
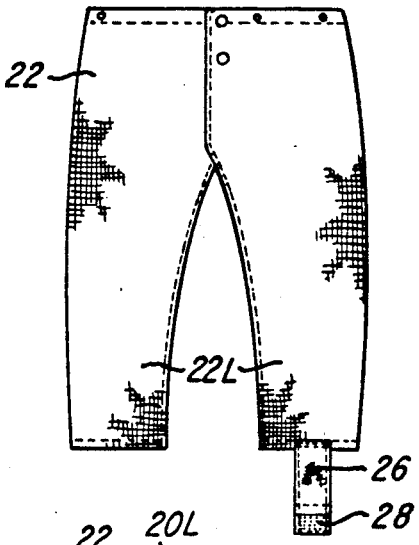
FIG-3
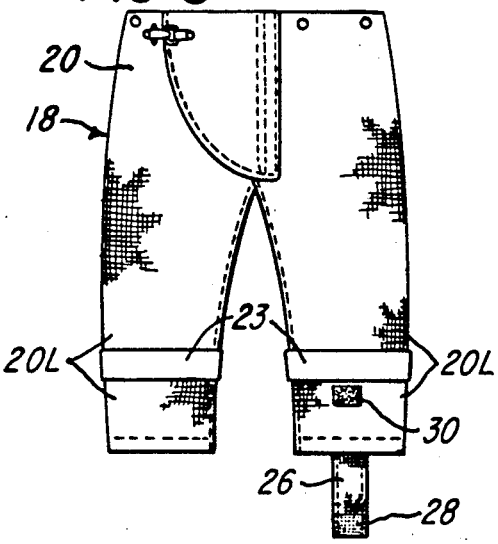
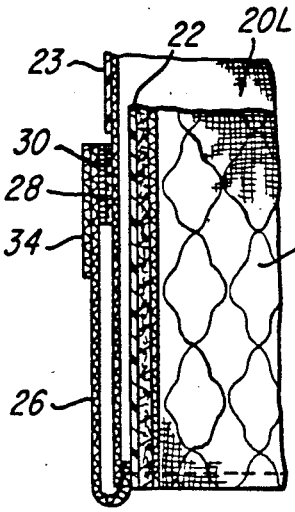
FIG-6
FIG-5
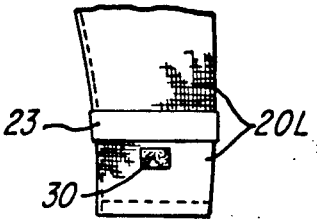

FIREFIGHTER'S GARMENT HAVING LINER DETECTION

BACKGROUND OF THE INVENTION

A firefighter's garments customarily have a plurality of layers. Customarily, each layer is of a material different from the materials of the other layers, and each layer serves a purpose different from the purpose of the other layers.

A firefighter's coat and a firefighter's trousers each have an inner liner or thermal barrier. Customarily, the inner liner and the other layers of the garment are attached together as a unit. This has become a custom because a firefighter has historically demonstrated the desire and tendency to remove a detachable inner liner from a firefighting garment. This is particularly true during hot weather. Removing the inner liner makes the garment cooler and more comfortable and reduces stress upon the firefighter, but also makes the garment unacceptable for firefighting protection.

This problem has become so significant that firefighting administrators now customarily request that an inner layer of a firefighter's garment be stitched to other layers of the garment to prevent disassembly of the garment. The permanent attachment of an inner liner to the other layers of a firefighter's garment has several disadvantages, as discussed below. However, stitching of an inner liner to the other layers of a firefighter's garment continues to be a custom, because when conventional firefighter garments are worn, a firefighting administrator cannot readily visually determine whether or not a firefighter is wearing a garment which has an inner liner.

As stated above, problems exist with regard to a firefighter's garment in which all layers are stitched together. During the fighting of a fire, the inner liner usually becomes saturated with perspiration. It is, of course, desirable to clean the inner liner. When the inner liner is attached to the other layers of the garment, the entire garment must be cleaned as a unit. Of course, it is desirable to clean the entire garment. However, the outer layer is covered with smoke and ashes and the like, and it is desirable to clean the inner liner in a different manner and/or in different solution from that in which the inner liner is cleaned. Also, an outer layer or an inner layer sometimes wears out or becomes damaged. It is desirable to be able to replace the damaged or worn layer without replacing the other layers.

This problem has been addressed in U.S. Pat. No. 4,507,806. This patent shows a firefighter's coat which has a collar which is attached to an inner liner. Therefore, the collar is removed when the inner liner is removed from the garment. Such a firefighter's garment is helpful toward solving the problem discussed above. However, when a firefighter is completely dressed for firefighting, with mask, helmet with ear flaps, etc., the absence of a collar from the coat may not be readily observable. However, the coat is usable even though the coat does not have a collar.

U.S. Pat. No. 4,774,725 shows a firefighter's coat having a slit therein. A strip of reflectorized material is attached to the outer surface of the outer shell near the slit. The liner which is removably attachable inside the outer shell includes a flap which is adapted to be inserted through the slit and attached to the outer surface to cover the strip of reflectorized material, so that an observer can tell whether or not the liner is present within the outer shell.

U.S. Pat. No. 4,817,210 shows a coat for firefighters in which a flap is attached to the rear portion of the inner liner and is attachable to the outer shell to cover indicia carried by the outer shell. The indicia states that the liner is out.

U.S. Pat. No. 4,768,233, which is owned by the inventors herein, shows an inner liner which has a section secured thereto which is attachable to the outer shell. The section serves as an element for attaching together two parts of the outer shell. Thus, when the inner liner is removed from the outer shell the garment is not usable by the firefighter.

Therefore, the structure of U.S. Pat. No. 4,768,233 notifies an observer of the garment that the liner is not present. However, in addition to notification, the structure of U.S. Pat. No. 4,768,233 prevents use of the garment when the liner is not present.

An object of this invention is to provide a more cost effective liner detection than has previously been devised.

Another object of this invention is to provide liner detector structure which has the important advantage of being self monitoring, in that the firefighter who wears a garment of this invention can readily observe the liner detection means.

It is an object of this invention to provide a firefighter's garment which is adapted to have an outer shell and an inner liner and which includes detection means by which the wearer of the garment or another person observing the garment can readily determine that there is no inner liner within the outer shell.

It is another object of this invention to provide such a firefighter's garment which may be a firefighter's coat or a firefighter's trousers.

It is another object of this invention to provide inner liner detection means which can readily included as part of a firefighter's garments of the conventional type.

It is another object of this invention to provide such inner liner detection means which can be positioned at any desired portion of a firefighter's garments.

It is another object of this invention to provide a firefighter's garmet which includes inner liner detection means which can be attached to an outer shell to indicate that the inner liner is present within the outer shell, or the detection means may remain unattached to an outer shell to indicate that the inner liner is present within the outer shell.

Other objects and advantages of this invention reside in the construction of parts, the combination thereof, the method of production and the mode of use as will become more apparent from the following description.

SUMMARY OF THE INVENTION

This invention provides garments for firefighters, including a coat and trousers, each of which is adapted to include an outer layer and an inner layer. One of the layers has an extension member which extends from that layer and which is attachable to the other layer as an indication that both layers are present in the garment. The extension member may also remain unattached to the other layer, and in an unattached condition provides an indication that the inner liner is present within the outer layer. Customarily, the extension member is attached to the inner layer and extends from the inner layer and from the outer layer to indicate that the inner layer is present within the outer layer.

BRIEF DESCRIPTION OF THE VIEWS OF THE DRAWINGS

FIG. 1 is a front elevational view showing a firefighter's coat and trousers constructed in accordance with this invention.

FIG. 2 is a front elevational view, drawn on a slightly larger scale than FIG. 1, showing a liner of the trousers of FIG. 1. This view shows the liner extension.

FIG. 3 is a front elevational view, drawn on substantially the same scale as FIG. 2, with the inner liner within the outer shell, showing the trousers of FIG. 1, with the liner extension unattached to the outer shell.

FIG. 4 is a front elevational view, drawn on substantially the same scale as FIG. 2, showing the trousers of FIGS. 1 and 3, with the inner liner within the outer shell and with the liner extension attached to the outer shell.

FIG. 5 is a fragmentary front view, drawn on substantially the same scale as FIGS. 2, 3, and 4, showing a lower leg portion of the outer shell of the trousers, and showing an attachment element carried by the lower leg portion for receiving and attaching the liner extension to the outer shell.

FIG. 6 is an enlarged sectional view taken substantially on line 6—6 of FIG. 4.

DETAILED DESCRIPTION OF THE PREFERRED EMBODIMENT

Figure 7:
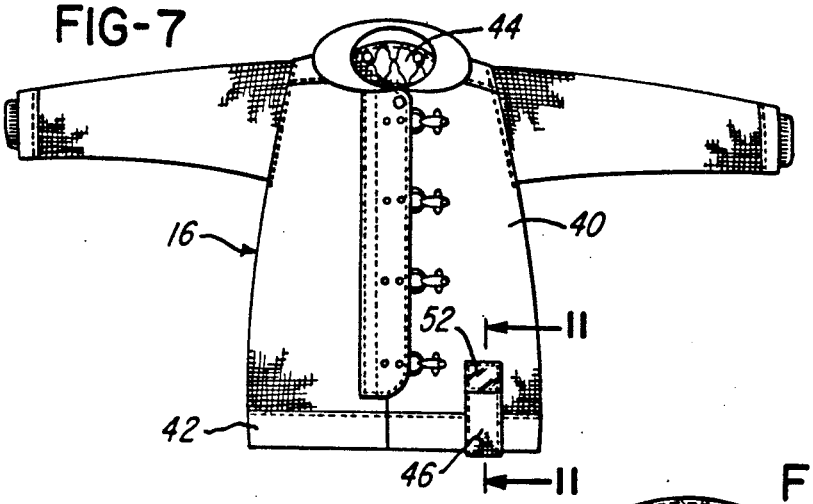
FIG. 7 is a front elevational view, drawn on a slightly larger scale than FIG. 1, showing the firefighter's coat of FIG. 1. This view shows the extension portion of the inner liner, as the inner liner is within the outer shell and the extension portion is attached to the outer shell.

FIG. 1 shows a firefighter's coat or jacket 16 and firefighter's trousers 18 of this invention.

The trousers 18 comprise an outer shell or outer layer 20 and an inner liner or inner layer 22, shown in FIG. 2. The outer shell 20 has leg parts 20L. A band 23 of reflective material is attached to the lower portion of each of the leg parts 20L. The inner liner 22 has leg portions 22L. Attached to the lower part of one of the leg portions 22L of the inner liner 22 is a liner extension member 26. The liner extension member 26 has a connection element 28 attached thereto. The connection element 28 may be any suitable connection device, such as a hook and pile connection device, as shown, or the connection element 28 may be a mechanical or metallic connection device.

When the inner liner 22 is within the outer shell 20, the extension member 26 extends downwardly from one of the leg parts 20L. The extension member 26 may hang downwardly from the leg part 20L of the trousers 18, as illustrated in FIG. 3. As the extension member 26 hangs downwardly from the inner liner 22 and from the outer shell 20, the extension member 26 provides an indication that the inner liner 22 is within the outer shell 20. Attached to the lower portion of the leg part 20L is a connection element 30, which may be any suitable connection device, such as a hook and pile connection element, as shown, or the connection element 30 may be a mechanical or metallic connection device. The hook and pile connection device of the connection element 30, is complementary to the hook and pile connection element 28 carried by the extension member 26, and the connection element 28 cooperates with the connection element 30 for attachment of the extension member 26 to the lower portion of the leg part 20L, as illustrated in FIGS. 1, 4, and 6.

The surface of the extension member 26 opposite the connection element 28 has attached thereto a reflective element 34. When the extension member 26 is attached to the leg part 20L by means of the connection elements 28 and 30, the reflective element 34 of the extension member 26 is visible and indicates that the inner liner 22 is within the outer shell 20.

Thus, it is understood that when the inner liner 22 is within the outer shell 20 of the trousers 18, the extension member 26 may hang downwardly from the leg part 20L of the outer shell 20 to indicate that the inner liner 22 is within the outer shell 20 or the extension member 26 may be attached to the outer shell 20 to indicate that the inner liner 22 is within the outer shell 20.

Thus, an observer can readily determine whether or not the trousers 18 include the inner liner 22.

FIG. 7 shows the coat or jacket 16 of FIG. 1. The coat 16 has an outer shell 40. The coat 16 is shown as having a lower trim element 42 of reflective material. An inner liner 44, shown in FIG. 8, is adapted to be positioned within the outer shell 40.

Figure 10:
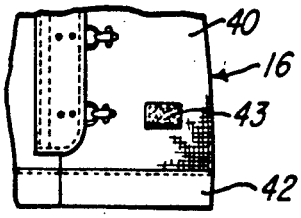
FIG. 10 is a fragmentary front view, drawn on substantially the same scale as FIGS. 7, 8, and 9, showing a portion of the coat of FIGS. 1 and 7, and showing the attachment means carried by the outer shell for receiving and attaching the liner extension to the outer shell.
Figure 9:
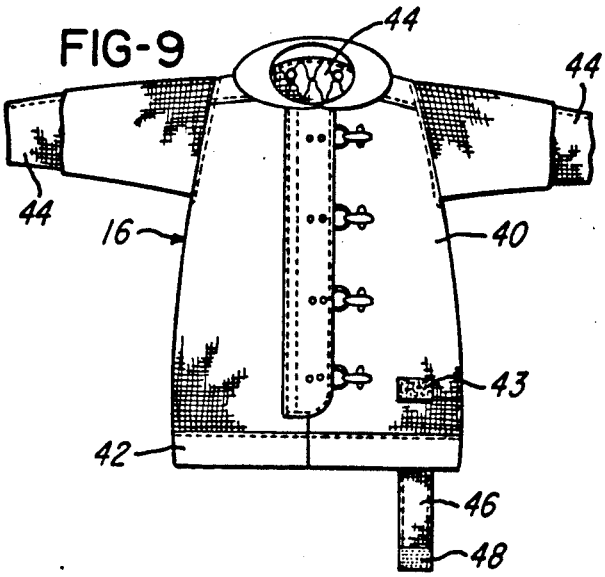
FIG. 9 is a fragmentary front elevational view, drawn on substantially the same scale as FIGS. 7 and 8, showing the firefighter's coat of FIGS. 1 and 7 and showing the extension portion of the inner liner extending from the inner liner and from the outer shell and not attached to the outer shell.

As shown in FIGS. 9 and 10, attached to the outer shell 40 in the lower portion thereof is a connection element 43, which may be any suitable connection device, such as, for example, a hook and pile connection element, as shown. The connection element 43 may be a mechanical or metallic member, if desired.

Figure 8:
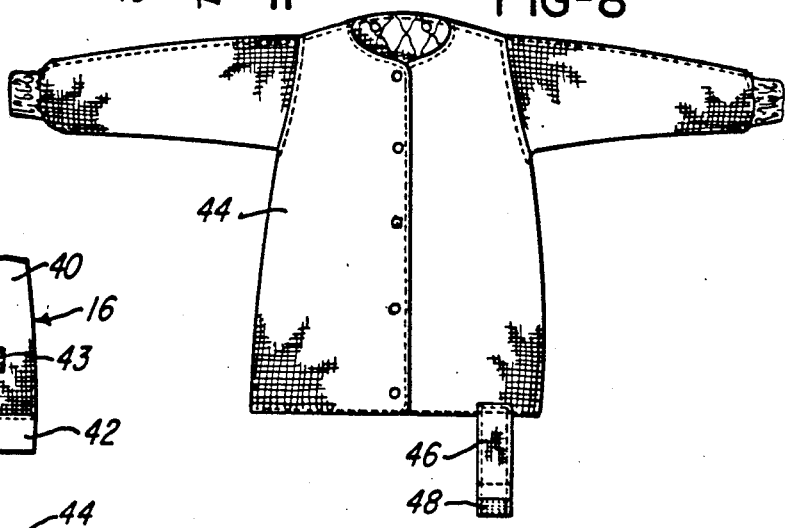
FIG. 8 is a front elevational view, drawn on substantially the same scale as FIG. 7, showing the inner liner of the coat of this invention and showing the liner extension.

The inner liner 44 includes an extension member 46 which extends downwardly from the lower part of the inner liner 44, as best shown in FIG. 8. The extension member 46 has attached thereto a connection element 48, which may be any suitable connection device, such as, for example, a hook and pile connection element, as shown. The connection element 43 may be a metallic or mechanical member, if desired. The hook and pile connection element 48 which is carried by the extension member 46 is adapted to be connected to the hook and pile connection element 43 which is carried by the outer shell 40.

Figure 11:
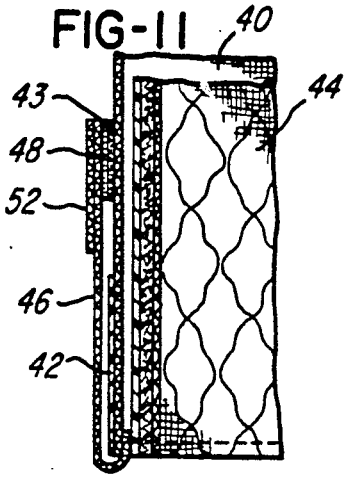
FIG. 11 is an enlarged sectional view, taken substantially on line 11—11 of FIG. 7.

FIG. 9 shows the coat 16 with the inner liner 44 within the outer shell 40. The extension member 46 is shown hanging downwardly from the inner liner 44 and from the outer shell 40. The coat 16 may be worn with the extension member 46 hanging downwardly therefrom as shown in FIG. 9. Thus, it is possible for an observer to determine that the inner liner 44 is within the outer shell 40. The extension member 46 is adapted to be attached to the outer shell 40, as the extension member 46 is turned upwardly, and the connection element 48 which is carried by the extension member 46 is attached to the connection element 43 which is carried by the outer shell 40. FIGS. 7 and 11 show the extension member 46 of the inner liner 44 attached to the outer shell 40.

Attached to the extension member 46 on the surface thereof opposite the connection element 48 is a reflective element 52. The reflective element 52 is readily visible when the extension member 46 is attached to the outer shell 40 in the manner shown in FIGS. 1 and 7.

Thus, this invention provides means by which an observer can easily and readily determine whether or not the inner liner 44 is within the outer shell 40 of the coat 16. This invention provides means by which an observer can easily and readily determine whether or not the trousers 18 include an inner liner 22 within the outer shell 20.

Although the preferred embodiments of the firefighter's garments of this invention have been described, it will be understood that within the purview of this invention various changes may be made in the form, configuration, details proportion and arrangement of parts, the method of construction and the materials employed, the combination thereof, and the manner of use, which generally stated consist in a firefighter's garment within the scope of the appended claims.

The invention having thus been described, the following is claimed:

1. A firefighter's garment comprising trousers, the trousers including an outer shell and an inner liner, the outer shell having a leg part and the inner liner having a leg part, the leg part of the inner liner including an extension member which extends downwardly from the leg part of the inner liner and which extends downwardly from the leg part of the outer shell, and connection means for attaching the extension member of the inner liner to the leg part of the outer shell to indicate that the inner liner is within the outer shell.

2. The firefighter's garment of claim 1 in which the leg part of the outer shell has an outer surface, first connection means, the first connection means being joined to the outer surface of the leg part of the outer shell, second connection means, the second connection means being joined to the extension member, the second connection means being attachable to the first connection means for attaching the extension member of the inner liner to the outer shell of the trousers.

3. A firefighter's garment which comprises an outer shell and an inner liner, the inner liner including an extension member which extends from the inner liner and which hangs freely downwardly from the inner liner and which hangs freely downwardly from the outer shell and whereby the extension member is free from attachment to the outer shell when the inner liner is within the outer shell, whereby the extension member as it hangs freely downwardly from the outer shell comprises the sole indicator means that the inner liner is within the outer shell.

4. A firefighter's garment which comprises an outer shell having a front portion and an inner liner having a front portion, the inner liner including an extension member which extends from the front portion of the inner liner and which extends from the front portion of the outer shell when the inner liner is within the outer shell, and means for attachment of the extension member to the front portion of the outer shell to indicate that the inner liner is within the outer shell, whereby an observer of the front portion of the garment can determine that the garment includes the inner liner, the garment comprising a firefighter's trousers, the trousers including an outer shell having a leg part and an inner liner having a leg part, the inner liner including an extension member which extends downwardly from the front portion of the leg part of the inner liner, and means for attaching the extension member of the inner line to the front part of the leg part of the outer shell.

5. A firefighter's garment which comprises an outer shell having a front portion and an inner liner having a front portion, the inner liner including an extension member which extends from the front portion of the outer liner and which extends from the front portion of the outer shell when the inner liner is within the outer shell, and means for attachment of the extension member to the front portion of the outer shell to indicate that the inner liner is within the outer shell, whereby an observer of the front portion of the garment can determine that the garment includes the inner liner, the firefighter's garment having a given width dimension, the extension member comprising a narrow element having a width dimension significantly less than the given width dimension of the garment.

* * * * *

UNITED STATES PATENT AND TRADEMARK OFFICE

CERTIFICATE OF CORRECTION

PATENT NO. : 5,038,410

DATED : August 13, 1991

INVENTOR(S) : William L. Grilliot and Mary I. Grilliot

It is certified that error appears in the above-identified patent and that said Letters Patent is hereby corrected as shown below:

Column 6, line 34, change "outer" to---inner---.

Signed and Sealed this

Tenth Day of November, 1992

*Attest:*

DOUGLAS B. COMER

*Attesting Officer*

*Acting Commissioner of Patents and Trademarks*